US005282657A

United States Patent [19]

Clinch et al.

[11] Patent Number: 5,282,657

[45] Date of Patent: Feb. 1, 1994

[54] DOOR HANDLE ASSEMBLY

[75] Inventors: Colin Clinch, Basingstoke, England; Per-Arne Axelsson; Kristian Ostergren, both of Gothenburg, Sweden

[73] Assignee: ITW Fixfast AB, Gothenburg, Sweden

[21] Appl. No.: 968,146

[22] Filed: Oct. 29, 1992

[30] Foreign Application Priority Data

Nov. 4, 1991 [SE] Sweden ..... 9103223

[51] Int. Cl.[5] ..... E05B 3/00

[52] U.S. Cl. ..... 292/336.3; 292/DIG. 23; 292/DIG. 31

[58] Field of Search ..... 292/336.3, 66, 100, 292/113, 216, 217, DIG. 23, DIG. 31, DIG. 38; 70/207, 208; 403/68, 69, 70, 163

[56] References Cited

U.S. PATENT DOCUMENTS

| | | | |
|---|---|---|---|
| 4,343,501 | 8/1982 | Meeks | 292/336.3 |
| 4,478,445 | 10/1984 | Shimizu | 292/336.3 |
| 4,497,514 | 2/1985 | Moriya et al. | 292/336.3 |
| 4,580,822 | 4/1986 | Fukumoto | 292/336.3 |
| 4,591,196 | 5/1986 | Kurita | 292/336.3 |
| 4,653,143 | 3/1987 | Ketelhut et al. | 292/336.3 |
| 4,818,003 | 4/1989 | Seko et al. | 292/336.3 |
| 5,005,885 | 4/1991 | Kobayashi et al. | 292/336.3 |

*Primary Examiner*—P. W. Echols
*Assistant Examiner*—David P. Bryant
*Attorney, Agent, or Firm*—Schwartz & Weinrieb

[57] ABSTRACT

A door handle assembly (10) to be mounted to a door, preferably a vehicle door, the assembly having a lock mechanism operating arrangement (11), made up of an operating handle (12) and an actuation lever (13), and a handle housing (14) to which the operating arrangement (11) is pivotally attached. To facilitate mounting of the door handle assembly to the door, the actuation lever (13) projects from the operating handle (12) at a predetermined fixed angle, and the actuation lever (13) is provided with an engagement surface (26) in the form of an open recess (31) directed away from the lock mechanism. The recess is intended to abut a portion (25) of actuation means (23) for the door lock when the door handle assembly is in its mounted state and the operating handle is displaced.

18 Claims, 3 Drawing Sheets

DOOR HANDLE ASSEMBLY

TECHNICAL FIELD

The present invention relates generally to a door handle assembly for a door, and more particularly to a door handle assembly for an automotive door lock system.

BACKGROUND OF THE INVENTION

In the manufacturing industry it is a common goal to optimize assembly techniques so that components can be assembled to produce a product in a minimum number of steps using a minimum number of components. This is particularly true in areas such as the automotive industry in which the final products, that is, motor vehicles, are produced in large volumes from a vast number of components. Clearly, if the number of individual components can be reduced and/or their assembly simplified, large cost savings can be gained.

Particularly, but not exclusively, in the automotive industry, the assembly of inner door handles to doors has entailed a relatively protracted procedure which has not lent itself to automation. On a typical assembly line, the door is first fitted with its lock mechanism and actuator rod (or cable) before the inner door handle is mounted. The inner door handle is in the form of a door handle assembly comprising a lock mechanism operating handle which cooperates with the lock mechanism actuator rod by means of an actuation lever integral with the operating handle, and a handle housing to which the handle is pivotally attached. In order to allow the operating handle to cooperate with the actuator rod which is normally within the door, the side of the door to which the assembly is to be fitted is provided with an aperture through which at least the actuation lever of the operating handle can project The door is also provided with suitable apertures to accommodate the handle housing.

The mounting of a door handle assembly of the above described kind to a vehicle door will be described in the following description. Firstly, the assembly-line worker brings the door handle assembly to a position slightly spaced from the door. He then reaches through the aperture in the door and grasps the actuator rod. The rod is carefully inserted into a clip on the actuation lever and the entire door handle assembly is pushed into the aperture(s) in the door in a plane perpendicular to the door. Once positioned in this plane, the assembly is slid back and forth in a plane parallel to the door in order to take up any slack in the lock mechanism. This slack is a result of inaccurate tolerances during the fabrication of the door, fitting of the lock mechanism and positioning of the respective apertures for the door handle assembly Once the slack has been taken up, the door handle assembly is fixed in place by means of screws passing through the handle housing and cooperating with the door. As is common practice in the automotive industry, a decorative trim panel is then attached to the inner side of the door by means of screws or clips at predetermined locations. In order to allow the door handle assembly to be accessed for operation, the panel is provided with an aperture Due to the necessary parallel sliding motion of the handle assembly during its mounting, the aperture in the trim panel must be large enough to expose the door handle assembly in any of its possible fixation locations. As a result, a gap of several millimeters between the trim panel and the handle housing is exposed on at least one side of the housing. In order to cover this gap, a finishing bezel is then mounted around the handle housing.

One attempt to simplify the above-described mounting procedure is described in SU 1370-212-A. This document relates to a door handle assembly which includes an operating arrangement in the form of a grippable operating handle and an auxiliary actuation lever, both journalled to a housing. The actuation lever is a double-arm lever with one arm being elastic and arranged to bear against the operating handle while the other arm is provided with a pair of angled projections defining a slot. The slot is intended to grippingly accommodate an end of a lock mechanism actuator rod which is held in a predetermined position within the door. The actuation lever is so as to be able to rotate independently of the operating handle over an adjustable range of movement delimited by an adjustment screw carried by the actuation lever and interacting with the operating handle. The mounting procedure for such an assembly is the following.

The operating arrangement is pre-assembled to the housing and the adjustment screw is slackened off completely. As the assembly is introduced into the door, one of the pair of angled projections abuts the actuator rod so as to thereby cause the actuation lever to rotate with respect to the operating handle until the slot of the actuation lever is aligned with the rod. Further displacement of the assembly towards the door causes the rod to latch in the slot and to be held therein by the pair of projections. The assembly is fixed to the door and the adjustment screw is used for adjusting the relative position of the operating handle and actuation lever so as to return the operating handle to a position in which it is flush with the housing.

The above-described arrangement allows the door handle assembly to be mounted to the door as a result of a movement of the assembly in a direction substantially perpendicular to the door.

Whilst the arrangement according to SU 1370-212-A offers advantages over previous mounting techniques, it is not suitable for automation due to the need for adjustment of the relative positions of the operating handle and actuation lever once the assembly is affixed to the vehicle door. In addition, the handle construction is relatively complex and relatively close tolerances are required to ensure that the slot on the actuation lever will align itself with the actuator rod.

OBJECTS OF THE INVENTION

It is therefore an object of the present invention to provide a door handle assembly for mounting on a door equipped with a lock mechanism which overcomes the disadvantages mentioned above.

It is a further object of the present invention to provide a door handle assembly for mounting to a door which permits the door handle assembly to be mounted to the door in a manner which is considerably quicker and easier than in accordance with conventional techniques.

SUMMARY OF THE INVENTION

These objects are achieved in accordance with the present invention by means of a door handle assembly which will be more particularly described hereinafter.

Preferred embodiments of the door handle assembly are also detailed in the respective attached claims.

BRIEF DESCRIPTION OF THE DRAWINGS

Various other objects, features, and attendant advantages of the present invention will be more fully appreciated from the following detailed description when considered in connection with the attached drawings, in which like reference characters designate like or corresponding parts throughout the several views, and wherein.

BEST MODE OF CARRYING OUT THE INVENTION

Figure 1:
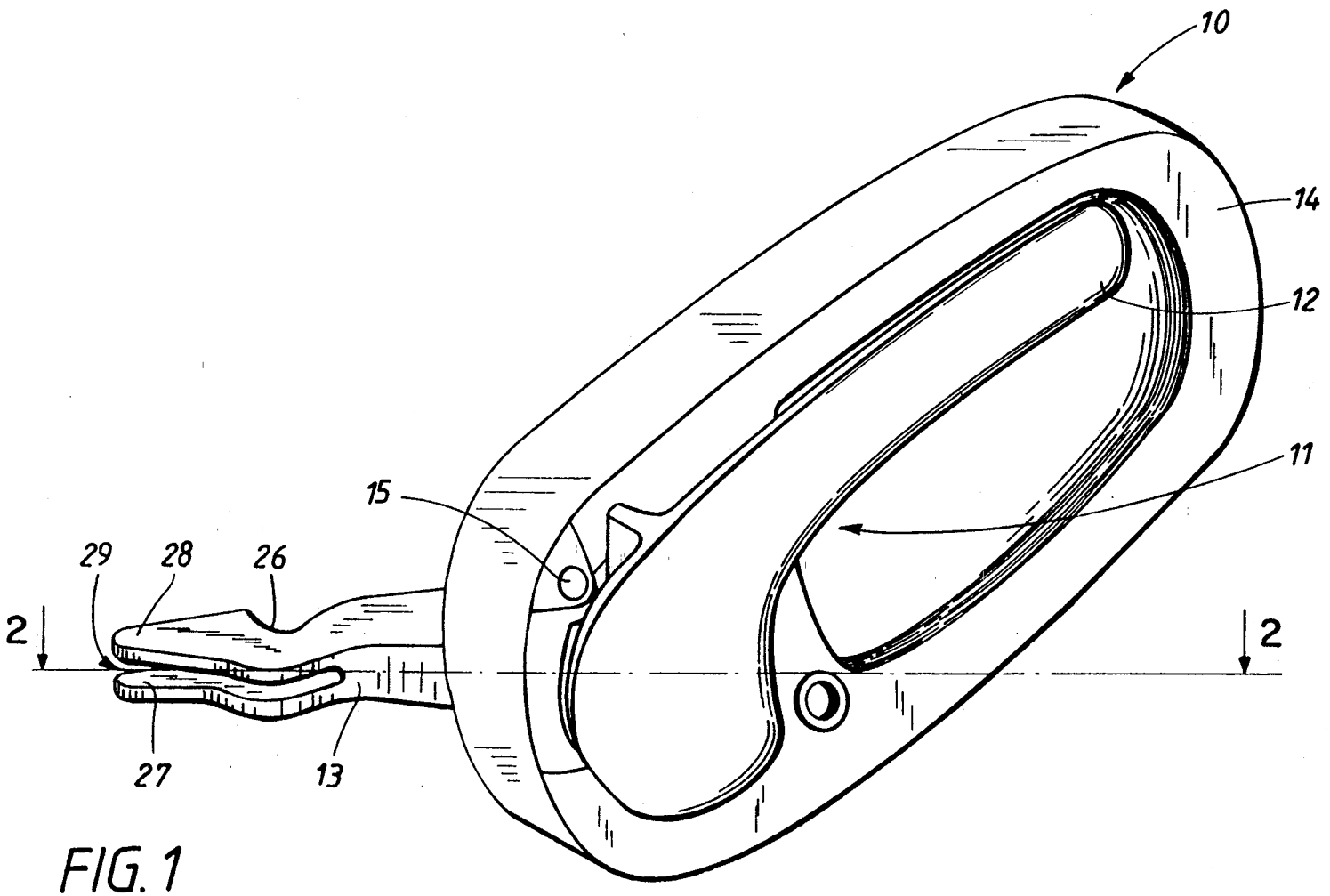
FIG. 1 is a schematic perspective view of a door handle assembly according to the present invention.

In the figures, reference numeral 10 denotes a door handle assembly according to the present invention. The assembly includes an operating arrangement, generally denoted by reference numeral 11, which is intended to effect operation of a lock mechanism incorporated in a door to which the assembly is attached. The operating arrangement 11 comprises an operating handle 12 and an actuation lever 13 which projects from the operating handle at a predetermined fixed angle. In the shown example the operating arrangement is of unitary construction, though it is of course conceivable that the operating handle 12 and the actuation lever 13 be individual components which are subsequently joined together. The assembly further comprises a handle housing 14 to which the operating arrangement 11 is pivotally attached by means of a pivot pin 15 or similar means arranged substantially at the intersection of the operating handle 12 with the actuation lever 13.

Figure 2:
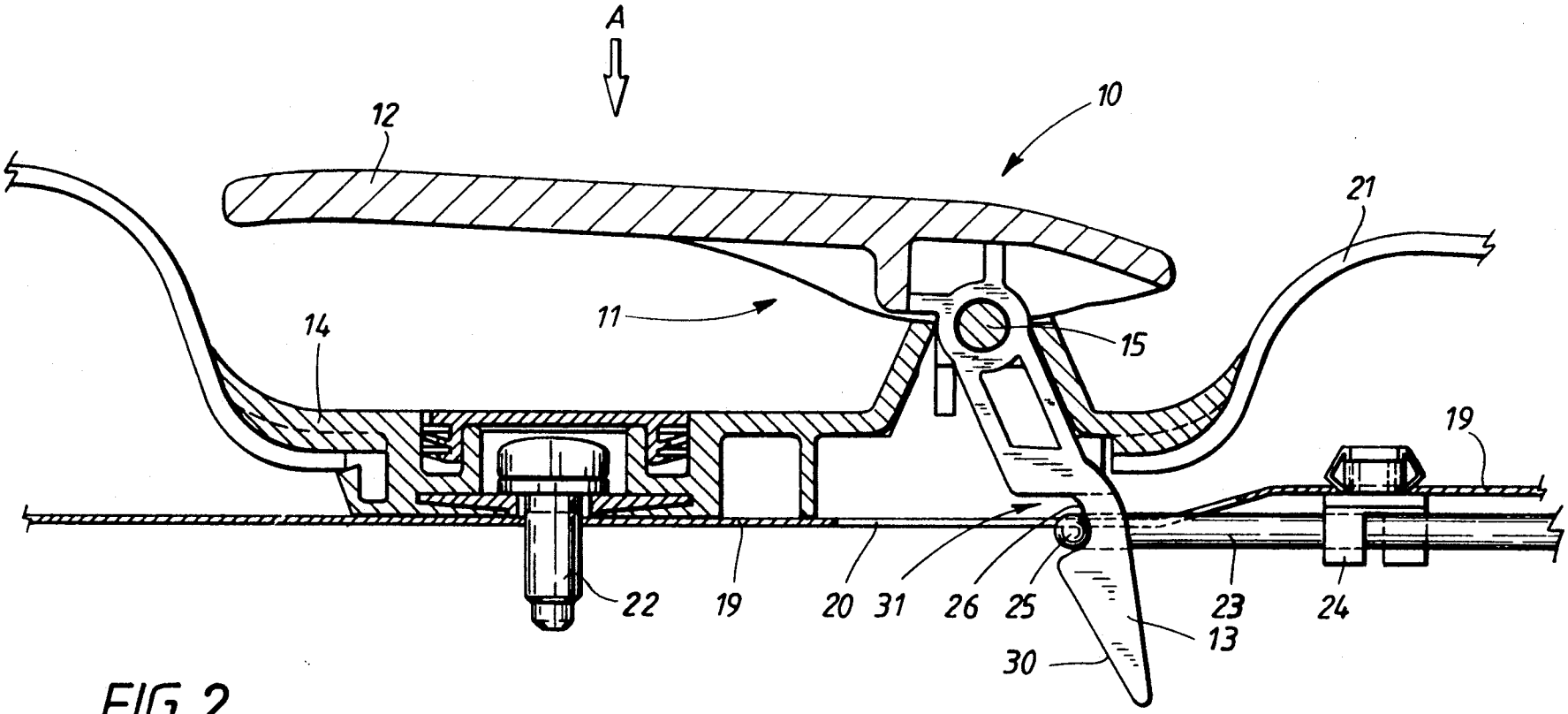
FIG. 2 is a sectional view along line 2—2 in FIG. 1 with the door handle assembly mounted on a door.

In FIG. 2 the handle assembly 10 is shown in its mounted state affixed to a surface 19 of a vehicle door The surface 19 may be a region of the inner door skin of the door or a bracing strut traversing the door and extending in a main plane of the door. The surface 19 may be provided with at least one aperture 20 to permit insertion of the actuation lever 13 into the door In the shown preferred embodiment, the handle assembly 10 is attached to a door trim panel 21 before the handle assembly 10 and the panel 21 are simultaneously mounted as one unit on the surface 19 of the door. Attachment of the handle assembly to the trim panel 21 can be by snap-in clip means, riveting, heat-sealing or any other suitable means. The trim panel 21 is affixed to the door by means of suitable clips or similar fasting means, not To ensure stability of the door handle assembly 10 on the door, a fastening means such as a screw or stud 22 may be provided which anchors the handle housing 14 to the door surface 19.

In accordance with the present invention, the mounting of the door handle assembly 10 and, in this case, the trim panel 21 to the door is effected with a movement of the assembly in a direction substantially perpendicular to the door inner surface 19, that is in the direction indicated by arrow A in FIG. 2. Since the door handle assembly 10 is already affixed to the trim panel 21 before being mounted on the door, no unsightly gap is revealed once the handle assembly and trim panel 21 are in situ on the door Similarly, because mounting is effected in a single plane in the direction of arrow A, accurate alignment of cooperating means on the door for the trim panel locating clips is relatively simple to ensure.

In a modified embodiment in accordance with the present invention, the door handle assembly 10 and the door trim panel 21 are mounted to the door in separate steps, that is the door trim panel 21 is affixed to the door prior to the mounting of the door handle assembly 10. Thus, the door trim panel 21 is first mounted to the door in any suitable manner, though preferably with a movement in a direction substantially perpendicular to the door inner surface. The door trim panel is provided with an aperture to allow the actuation lever 13 of the door handle assembly to pass therethrough as the door handle assembly 10 is brought towards the door in accordance with the present invention in a direction substantially perpendicular to the door. This aperture may either be large enough to permit a locating means such as a screw to pass through the door handle assembly 10 and to engage with the door in order to secure the assembly 10 thereto, or a separate aperture for the locating means may be provided. In the door handle assembly's mounted state, the handle housing 14 rests against the side of the trim panel remote from the door By providing a handle housing which is expansive enough to cover the aperture in the trim panel for the actuation lever 13, the door handle assembly can be affixed to the door without the need for a finishing bezel.

The present invention provides several embodiments to ensure cooperation between the lock mechanism (not shown) and the door handle assembly 10 when the assembly is mounted to the door. As shown in FIG. 2, an actuator rod 23 extends from the lock mechanism towards the door handle assembly 10. In the shown example, the actuator rod 23 is positioned within the door, and the aperture 20 in the door surface 19 is therefore necessary to allow the actuation lever 13 of the door handle assembly to engage the actuator rod. It is, however, also feasible that the actuator rod may be disposed outside the door, that is between the door surface 19 and the trim panel 21. If this is the case, then the aperture 20 may not be required.

In most instances the lock mechanism is provided with spring-biasing means to draw the actuator rod 23 towards the lock mechanism. This spring-biasing means enables the actuator rod to be displaced a certain amount in a longitudinal direction towards the door handle assembly 10 without the lock mechanism being actuated. The spring-biasing force also ensures the return of the lock mechanism and the operating arrangement 11 to their rest state as shown in FIG. 2. The return function of the spring-biasing means may be complemented by a return spring on or within the door handle assembly 10, or, in the extreme case, entirely substituted by such a return spring.

To ensure lateral alignment of the actuator rod 23, a guide 24 is provided on the door in the vicinity of the handle assembly 10. In the shown embodiment, the end of the actuator rod nearest the handle assembly is bent outwardly to form a right angle with the remainder of the rod 23. This outwardly bent region of the actuator rod 23 serves as an engagement portion 25 for cooperation with an engagement surface 26 on the actuation lever 13 of the operating arrangement 11. As can best be seen from FIG. 1, in a preferred embodiment the actuation lever is fork-shaped, that is the lever 13 is provided with two shanks 27, 28 with a gap 29 therebetween. The gap 29 is arranged to be slightly larger than the diameter or thickness of the actuator rod 23 so that the rod may pass between the two shanks 27, 28. With particular reference to FIG. 2, the actuation lever 13 is arranged to project into the door cavity at an angle to the normal direction denoted by arrow A in a direction towards the lock mechanism. In this manner, the surface of the upper shank 28 facing away from the lock mechanism forms a guide ramp 30 for the engagement portion 25 of the actuator rod 23. The guide ramp 30 extends from the remote tip of the actuation lever 13 and merges with the engagement surface 26 which is formed in a recess 31 on the lever. In accordance with the invention, the recess 31 is open in a direction facing away from the lock mechanism.

As was explained earlier, if the actuator rod 23 is positioned between the door surface 19 and the trim panel 21, then no aperture in the door surface may be necessary, that is the actuation lever 13 does not need to project into the door cavity.

The engagement of the actuator rod 23 with the actuation lever 13 during mounting of the door handle assembly 10 to the door will now be explained for the case in which the actuator rod 23 is positioned within the door. The length of the actuator rod 23 is so chosen that in its retracted state its engagement portion 25 lies within the aperture 20 such that, during mounting of the door handle assembly 10, the remote tip of the actuation lever 13 can pass between the engagement portion 25 and the lock mechanism. Due to the lateral alignment of the actuator rod 23 by means of the guide 24, the actuator rod will enter the gap 29 between the two shanks 27, 28. Accordingly, as the door handle assembly is being presented to the door, the engagement portion 25 of the actuator rod 23 will contact the guide ramp 30 on the upper shank 28 of the actuation lever 13. If the actuator rod 23 is spring-biased, during further insertion of the actuation lever 13 into the door, the guide ramp 30 displaces the engagement portion 25 away from the lock mechanism until the guide ramp merges into the recess 31. At this juncture, the engagement portion 25 of the actuator rod 23 is drawn into contact with the engagement surface 26 of the recess 31.

The door handle assembly is now able to operate the lock mechanism by pivoting the operating handle 12 about the pivot 15 so as to draw the actuation lever 13 away from the lock mechanism. Since the actuator rod is constrained by the guide 24 to slide in one plane essentially parallel to the door surface 19, the recess 31 is shaped and dimensioned so as to retain the engagement portion 25 of the actuator rod during this motion. Once the operating handle 12 has been rotated sufficiently, the lock mechanism is activated and the handle 12 may then be released. Due to the spring-biasing means in the lock mechanism, the operating arrangement 11 of the door handle assembly 10 is returned to its rest position which corresponds to the position shown in FIG. 2.

In order to keep production costs as low as possible, it is desirable to be able to provide the various components of the door, door trim panel, lock mechanism and door handle assembly with as large production tolerances as possible Thus, in the door handle assembly's mounted state, it is possible that the actuator rod 23 extends across the aperture 20 to such an extent that its engagement portion 25 does not abut the engagement surface 26 of the actuation lever 13 when the door handle assembly is in its rest position. Instead, contact between the engagement portion 25 and the engagement surface 26 will first be made after a certain initial rotation of the operating arrangement 11 about the pivot pin 15. Further rotation of the operating arrangement will then lead to the actuation of the lock mechanism. Once actuation has been achieved, upon release of the operating handle 12, the actuation rod 23 will be drawn towards the lock mechanism due to the spring-biasing until the rod reaches its rest position. During this return motion, the engagement portion 25 of the actuator rod is in contact with the engagement surface 26 on the actuation lever 13 so that the operating arrangement is also returned towards its rest position. However, since the rest position of the actuator rod 23 does not correspond with the desired rest position of the operating arrangement, that is with the operating handle 12 substantially "flush" with the handle housing 14 as shown in FIG. 2, the operating handle 12 remains in a partially projecting condition. This is unsatisfactory from both a safety and an aesthetic viewpoint.

Figure 3:
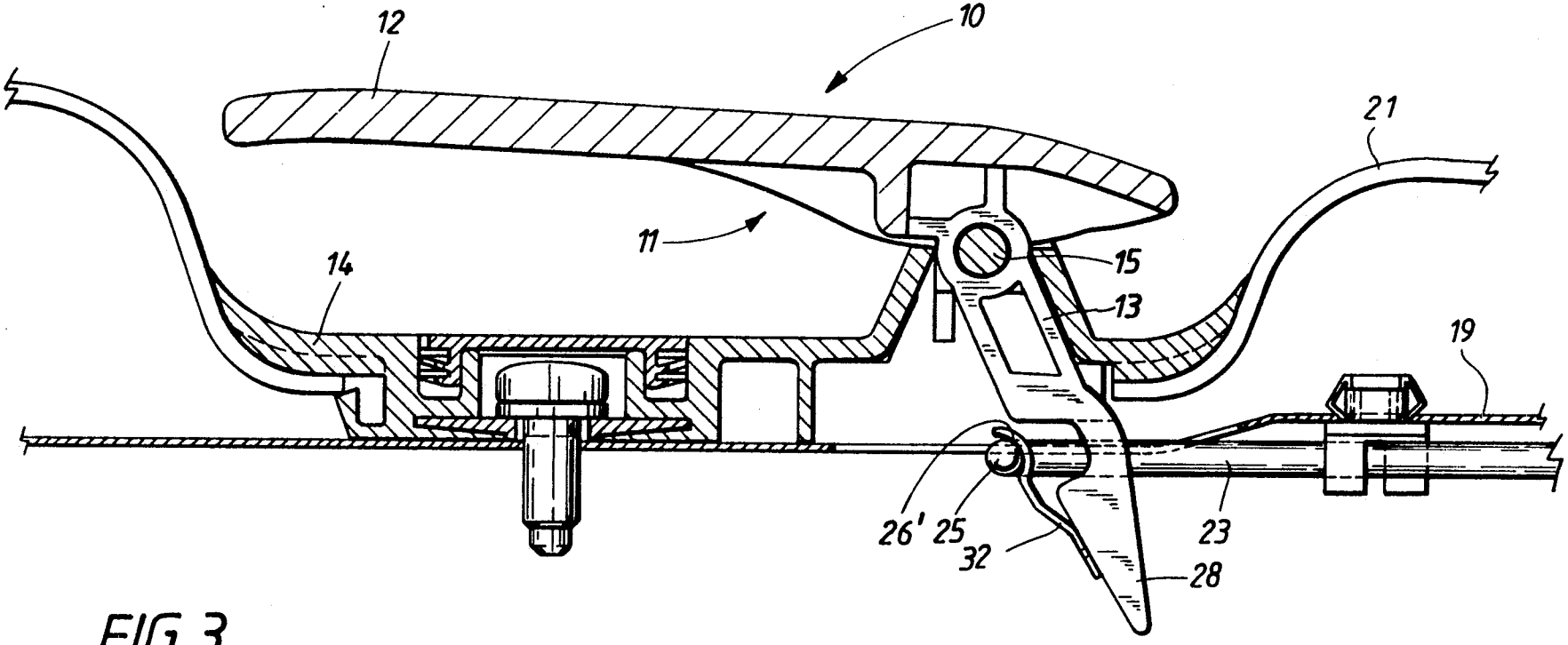
FIG. 3 is a view similar to that of FIG. 2 but shows a modification to the embodiment according to FIG. 2.

Thus, in a further embodiment in accordance with the present invention as shown in FIG. 3, the actuation lever 13 is provided with a spring member, for example a leaf spring 32, attached to, or integrally formed with, the upper shank 28 of the actuation lever 13. The degree to which the spring member 32 projects from the actuation lever 13 can be selected such that the engagement portion 25 of the actuator rod 23 will always be in contact with an engagement surface 26, which is provided upon the spring member 32. Due to the force reaction between the spring member 32 and the engagement portion 25 of the actuator rod 23, the operating arrangement 11 is returned to its desired rest position, that is with the operating handle 12 flush with the handle housing.

In the case where the actuator rod 23 is positioned between the door surface 19 and the trim panel 21, the engagement procedure between the actuator rod 23 and the actuation lever 13 is the same as for when the rod 23 is within the door, though with the exception that the length of the actuator rod 23 is selected such that the position of its engagement portion 25 lies within the aperture in the trim panel 21 through which the actuation lever 13 projects.

From the above description it will be apparent that the mounting operation of this type of door handle assembly to a door does not require the actuator rod to be manually attached to the actuation lever before the actuation lever is mounted to the door.

Furthermore, exact longitudinal positioning of the engagement portion 25 of the actuator rod 23 in either the aperture 20 or the aperture in the trim panel is not necessary. What is required is merely that, once the door handle assembly is mounted to the door, the engagement surface 26 contacts the engagement portion 25 during operation of the lock mechanism.

By ensuring that the recess 31 merges at an obtuse angle into the guide ramp 30 on the actuation lever 13, the door handle assembly can also be removed from the door by withdrawing the assembly along the same path as it was inserted. This withdrawal possibility also exists with the embodiment in which the spring member 32 is provided.

If accurate longitudinal alignment of the actuator rod were to be provided, then a simplified actuation lever 13 could be used. Thus, in a further embodiment of the present invention (not shown), the engagement portion of the actuator rod is in the form of a loop and the actuation lever passes through the loop to effect displacement of the actuator rod. Should the door handle assembly need to be removed from the door, the actuation lever is merely withdrawn from the loop. The shape of the engagement portion may be selected according to circumstances. For example, the engagement portion may be ball-shaped or disc-like.

Naturally the present invention is not restricted to that described above, but may be varied within the scope of the appended claims. For example, the actuator rod may be in the form of a Bowden cable whose outer casing is held by a clip in the vicinity of the door handle assembly and whose inner cable is provided with a nipple which forms the engagement portion. Furthermore, whilst the door handle assembly has been described in connection with motor vehicle doors, such a handle assembly could also be employed on other types of doors, such as refrigerator doors, store room doors, or the like. Indeed, it will be apparent to the skilled man that in the case where the lock mechanism is positioned on the door frame adjacent the door, the door handle assembly would not in fact be mounted on the door, but instead in cooperation with the lock mechanism adjacent the door. Whilst a suitable material for the door handle assembly is an injection-mouldable plastic, it is conceivable that a part or all of the assembly be manufactured from metal. It is therefore to be understood that within the scope of the appended claims, the present invention may be practiced otherwise than as specifically described herein.

What is claimed is:

1. A door handle assembly for operating a lock mechanism of a door, comprising:

a door handle housing;

a lock mechanism operating arrangement comprising an operating handle and an actuation lever fixed to said operating handle;

pivot pin means for pivotably mounting said lock mechanism operating arrangement upon said door handle housing about a pivotable axis;

said actuation lever comprising a bifurcated member defining a pair of axially spaced shank portions disposed within first and second parallel planes disposed perpendicular to said pivotable axis and defining a gap therebetween which is disposed within a third plane interposed between and parallel to said first and second planes within which said axially spaced shank portions are disposed;

recess means defined within at least one of said pair of axially spaced shank portions of said actuation lever bifurcated member; and a lock mechanism actuation rod having a first portion disposed within said third plane so as to be disposed within said gap defined between said pair of axially spaced shank portions, and a second axially extending portion disposed substantially perpendicular to said first portion and substantially parallel to said pivot pin means, and disposed within said recess means of said at least one of said pair of axially spaced shank portions of said actuation lever bifurcated member for operatively connecting said lock mechanism operating arrangement to a lock mechanism of said door.

2. An assembly as set forth in claim 1, wherein:

said actuation lever is disposed at a predetermined fixed angle with respect to said operating handle; and said pivot pin means is disposed at a location at which said actuation lever and said operating handle intersect.

3. An assembly as set forth in claim 1, wherein:

said actuation lever and said operating handle are integrally formed such that said operating arrangement comprising said operating handle and said actuation lever comprise a unitary construction.

4. An assembly as set forth in claim 1, wherein:

said door comprises a vehicle door.

5. An assembly as set forth in claim 4, wherein:

said vehicle door comprises a door surface; and said door handle housing is fixedly mounted upon said door surface.

6. An assembly as set forth in claim 5, wherein:

said door surface has an aperture formed therein; and said door handle housing and said operating handle are disposed exteriorly of said door surface, while said actuation lever extends through said door surface aperture such that said shank portions of said actuation lever are disposed interiorly of said door surface so as to be operatively connected to said actuation rod.

7. An assembly as set forth in claim 5, further comprising:

guide means fixedly mounted upon said door surface for defining the disposition of said actuation rod with respect to said door so as to insure proper engagement of said actuation rod with said actuation lever whereby said first portion of said actuation rod will be disposed within said gap defined between said shank portions of said actuation lever.

8. An assembly as set forth in claim 4, wherein:

said vehicle door comprises a door trim panel; and said door handle housing, said operating handle, and said actuation lever are mounted upon said door trim panel.

9. An assembly as set forth in claim 8, wherein:

said vehicle door further comprises a door surface; and said door handle housing, said operating handle, said actuation lever, and said door trim panel are fixedly mounted upon said door surface.

10. An assembly as set forth in claim 9, wherein:

said door surface has an aperture defined therein; and said door handle housing, said operating handle, and said door trim panel are disposed exteriorly of said door surface, while said actuation lever extends through said door surface aperture such that said shank portions of said actuation lever are disposed interiorly of said door surface so as to be operatively connected to said actuation rod.

11. An assembly as set forth in claim 9, further comprising:

guide means fixedly mounted upon said door surface for insuring proper disposition of said actuation rod with respect to said actuation lever whereby said first portion of said actuation rod will be disposed within said gap defined between said shank portions of said actuation lever.

12. An assembly as set forth in claim 1, further comprising:

spring means fixedly mounted upon said at lest one of said pair of axially spaced shank portions of said actuation lever;

wherein said recess means is defined within said spring means whereby said second portion of said actuation rod is disposed within said recess means defined within said spring means of said at least one of said pair of shank portions.

13. An assembly as set forth in claim 12, wherein:

said spring means comprises a leaf spring.

14. An assembly as set forth 1, wherein:

said actuation rod comprises a Bowden cable.

15. An assembly as set forth in claim 1, wherein:

said door comprises an appliance door.

16. An assembly as set forth in claim 15, wherein:

said appliance door is a refrigerator door.

17. An assembly as set forth in claim 1, wherein:

said door handle housing, said operating handle, and said actuation lever are fabricated from a plastic material.

18. An assembly as set forth in claim 1, wherein:

said door handle housing, said operating handle, and said actuation lever are fabricated from metal.

* * * * *